US010995945B2

(12) United States Patent
Abbott

(10) Patent No.: US 10,995,945 B2
(45) Date of Patent: May 4, 2021

(54) BIOMASS PELLET COMBUSTION SYSTEM

(71) Applicant: United States Stove Company, South Pittsburg, TN (US)

(72) Inventor: Steven Blake Abbott, South Pittsburg, TN (US)

(73) Assignee: United States Stove Company, South Pittsburg, TN (US)

( * ) Notice: Subject to any disclaimer, the term of this patent is extended or adjusted under 35 U.S.C. 154(b) by 94 days.

(21) Appl. No.: 16/101,260

(22) Filed: Aug. 10, 2018

(65) Prior Publication Data

US 2019/0234610 A1 Aug. 1, 2019

Related U.S. Application Data

(60) Provisional application No. 62/543,582, filed on Aug. 10, 2017.

(51) Int. Cl.

| | |
|---|---|
| ***F23B 50/12*** | (2006.01) |
| ***F23B 80/04*** | (2006.01) |
| ***F24B 13/04*** | (2006.01) |
| ***F24B 5/02*** | (2006.01) |
| ***F24B 1/18*** | (2006.01) |

(Continued)

(52) U.S. Cl.

CPC ..... *F23B 50/12* (2013.01); *F23B 80/04* (2013.01); *F24B 1/026* (2013.01); *F24B 1/08* (2013.01); *F24B 1/18* (2013.01); *F24B 1/192* (2013.01); *F24B 1/195* (2013.01); *F24B 1/199* (2013.01); *F24B 5/026* (2013.01); *F24B 5/028* (2013.01); *F24B 13/02* (2013.01); *F24B 13/04* (2013.01); *F23B 2700/018* (2013.01)

(58) Field of Classification Search

CPC .... F23B 10/02; F23B 1/38; F23B 5/02; F23B 50/12; F23B 80/04; F23B 2700/018; F23B 2900/00001; F24B 5/028; F24B 5/026; F24B 1/026; F24B 1/08; F24B 1/18; F24B 1/192; F24B 1/195; F24B 1/199; F24B 13/04; F24B 13/02

USPC ..... 126/501, 73, 77, 523, 146

IPC ..... F24B 1/08,1/02, 1/18, 1/195, 1/199, F24B 5/02; F23B 50/12, 80/04

See application file for complete search history.

(56) References Cited

U.S. PATENT DOCUMENTS 39,535 A * 8/1863 Treadwell ..... F24B 5/04 126/68

85,255 A * 12/1868 Thatcher ..... F24B 1/199 126/501

(Continued)

FOREIGN PATENT DOCUMENTS

GB 729875 A * 5/1955 ..... F23B 80/04

GB 2089026 A * 6/1982 ..... F24B 1/02

(Continued)

*Primary Examiner* — Daniel E. Namay

(74) *Attorney, Agent, or Firm* — Mark A. Pitchford; Eric B. Fugett; Pitchford Fugett, PLLC

(57) ABSTRACT

A biomass pellet combustion system includes a primary burn chamber, a coal burn chamber, and a gas burn chamber. The primary burn chamber is configured to receive pellets from a drop tube of the biomass pellet combustion system. The coal burn chamber is configured to receive coals from the primary burn chamber. The gas burn chamber is configured to receive combustible gases from both the primary burn chamber and the coal burn chamber, wherein a secondary combustion process converts secondary combustion air and the combustible gases into exhaust gases in the gas burn chamber.

16 Claims, 10 Drawing Sheets

(51) Int. Cl.

| | |
|---|---|
| ***F24B 1/02*** | (2006.01) |
| ***F24B 13/02*** | (2006.01) |
| ***F24B 1/08*** | (2021.01) |
| ***F24B 1/192*** | (2006.01) |
| ***F24B 1/195*** | (2006.01) |
| ***F24B 1/199*** | (2006.01) |

(56) References Cited

U.S. PATENT DOCUMENTS 104,376 A * 6/1870 Thatcher ..... F24B 1/199 126/501
227,345 A * 5/1880 Bovey ..... B60H 1/00364 126/56
625,417 A * 5/1899 Rider ..... F24B 1/024 126/73
862,142 A * 8/1907 Dimpsey ..... F24H 3/00 126/102
1,223,768 A * 4/1917 Clark ..... F24B 5/026 126/77
3,809,056 A * 5/1974 Snelling ..... A23B 4/0523 126/59.5
4,258,692 A * 3/1981 Mackey ..... F24B 13/02 126/152 B
4,351,315 A * 9/1982 Babbage ..... F24B 9/04 126/501
4,366,802 A * 1/1983 Goodine ..... F23B 1/36 110/108
5,014,680 A * 5/1991 Siemer ..... F23N 5/003 126/77
5,133,266 A * 7/1992 Cullen ..... F23B 1/00 110/110
5,137,012 A * 8/1992 Crossman, Jr. ..... F24B 1/024 110/110
5,429,110 A * 7/1995 Burke ..... A47J 37/0704 110/110
5,469,836 A * 11/1995 Greenall ..... F24B 5/021 126/193
5,680,855 A * 10/1997 Ko ..... F24B 1/1885 126/68
5,873,356 A * 2/1999 Vossler ..... F24B 1/024 126/110 E
6,595,199 B1 * 7/2003 Andersen ..... F24B 1/028 126/77
2007/0089733 A1 * 4/2007 Bast ..... F23B 1/26 126/361.1
2009/0038603 A1 * 2/2009 Hepper ..... F24B 1/024 126/73
2014/0251299 A1 * 9/2014 Zhu ..... F24B 1/188 126/77
2014/0315137 A1 * 10/2014 Pedersen ..... F23N 3/06 431/12
2015/0054284 A1 * 2/2015 Nathan ..... F03G 6/00 290/52

FOREIGN PATENT DOCUMENTS

GB 2469938 A * 11/2010 ..... F24B 13/04
GB 2501875 A * 11/2013 ..... F24B 13/02
GB 2505217 A * 2/2014 ..... F24B 5/026
GB 2530668 A * 3/2016 ..... F23M 7/00
JP 2009047350 A * 3/2009 ..... F24B 1/02
WO WO-9964789 A1 * 12/1999 ..... F23N 5/003

* cited by examiner

BIOMASS PELLET COMBUSTION SYSTEM

CROSS-REFERENCES TO RELATED APPLICATIONS

This application claims priority to U.S. Provisional Patent Application No. 62/543,582 entitled "GRAVITY FED GASIFYING PELLET HEATING APPLIANCE" filed on Aug. 10, 2017.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to biomass pellet heating appliances. More particularly, this invention pertains to a gravity fed biomass pellet heating appliance (e.g., stove).

Wood or biomass pellets used for heating purposes offer a certain level of appeal over traditional cordwood. They can be purchased by the bag (typically 40 lbs each) or in bulk. They are convenient, clean, and easy to store. A user pours them into a fuel hopper of a wood pellet burning heating appliance (i.e., pellet stove) with very little mess. They are also at an optimal moisture content at the point of purchase, so no drying time is required. In contrast, cordwood has to be cut, split, stored, and dried before it is ready to be used. This can be quite a laborious and messy process, and that mess is inevitably carried into the home or space to be heated. Additionally, it takes two years on average to air dry cordwood to optimal moisture content for use in today's high efficiency wood burning heating appliances. Therefore, pellet heating appliances are much more convenient due to the decreased labor, time, and mess. Pellet heating appliances are also much more convenient to suburban and urban residents because users do not have to have a source of trees to cut and process for use with their wood burning appliance.

While pellet burning heating appliances offer a level of convenience above cord wood burning appliances, there are still some negative attributes. Pellet burning heating appliances are a type of space heater that typically use a series of motors, blowers, and some level of control logic to burn wood pellets. This means that high efficiency pellet heating appliances require an electrical source to operate. Therefore, during a power outage or failure of the user's solar power system, the user and the space to be heated can be left without a heat source. Electrically operated heating appliances also have moving parts that can fail, requiring replacement for before resuming operation.

Some pellet burning heating appliances require regular maintenance several times a week and detailed cleanings up to several times a heating season (depending on usage). These periods of maintenance and cleaning are primarily to remove ash and deposits from the heating appliance. If this maintenance and cleaning is not performed, blockages can occur that cause the system to shut down and/or possibly damage the appliance. Since most pellet heating appliances are blower driven, they have an induced flame that can be violent which some users consider unappealing when compared to a traditional gas flame or cordwood flame. Most pellet heating appliances and cordwood heating appliances rely on room air fans to distribute heat into the space to be heated which replaces the warm radiating heat of a traditional wood burning heating appliance with forced air but is much more efficient at heating an entire space evenly.

One pellet heating appliance design, disclosed in U.S. Patent Publication No. 2007/0186920, eliminates the need for electricity by relying on gravity to feed wood pellets to the combustion chamber and a strong natural draft to replace the electric blowers. This allows the heating appliance to radiate its heat more and eliminate the room air fan from the heating appliance. However, this design requires multiple maintenance and cleaning cycles per week in order to remain in a safe and efficient operating state. Further, this design does not provide aesthetically pleasing flames.

BRIEF SUMMARY OF THE INVENTION

Aspects of the present invention provide a biomass pellet combustion system. In one embodiment, the biomass pellet combustion system forms a wood pellet heating stove. The wood pellet heating stove is gravity fed, without the use of augers or electric motors. The stove has a primary combustion chamber defined by a grate or porous combustion pot, a secondary combustion zone below the grate, and a tertiary combustion zone above the primary combustion zone. Primary combustion air enters the stove at the secondary combustion zone to promote combustion and/or gasification of coals in the secondary combustion zone and pellets in the primary combustion zone. Combustible gases from the primary and secondary combustion zones rise into the tertiary combustion zone. Secondary combustion air enters the tertiary combustion zone near a top of the tertiary combustion zone at the front of the tertiary combustion zone to provide a wall wash effect on a front window of the tertiary combustion zone. Exhaust gases rise from the tertiary combustion zone into a heat transfer system of the stove and exit the stove through a flue of the stove.

In one aspect, a biomass pellet combustion system includes a primary burn chamber, a coal burn chamber, and a gas burn chamber. The primary burn chamber is configured to receive pellets from a drop tube of the biomass pellet combustion system. The coal burn chamber is configured to receive coals from the primary burn chamber. The gas burn chamber is configured to receive combustible gases from both the primary burn chamber and the coal burn chamber, wherein a secondary combustion process converts secondary combustion air and the combustible gases into exhaust gases in the gas burn chamber.

In another aspect, a gravity fed gasifying biomass pellet stove is provided. Primary combustion air enters a coal burn chamber of the stove and passes up through a grate supporting biomass pellets to a primary burn chamber. As pellets outgas releasing combustible gas, the pellets turn to coals and fall through the grate to the coal burn chamber. The coals continue to outgas combustible gases and the combustible gases flow from the primary burn chamber and the coal burn chamber to the gas burn chamber. Some of the primary air entering the coal chamber joins with the combustible gas from the primary burn chamber as the combustible gases pass from the primary burn chamber to the gas burn chamber. Biomass pellets are fed by gravity from a hopper above the primary burn chamber. All combustion air (i.e., primary and secondary combustion air) enters the stove through a wall of the coal burn chamber, and the burn rate of the stove is controlled by controlling the amount of combustion air allowed to enter the coal burn chamber.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
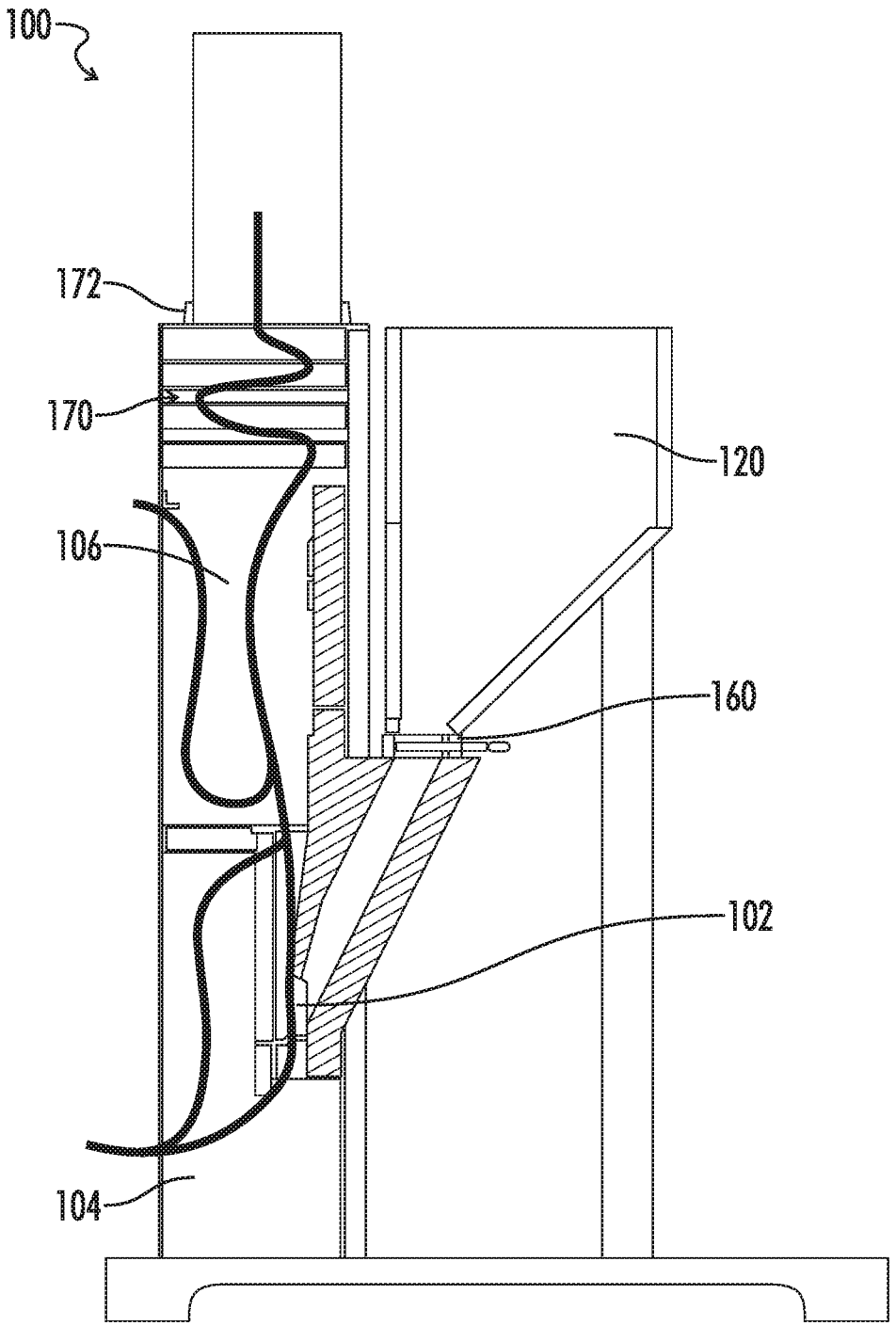
FIG. 1 is an air flow diagram of a biomass pellet combustion system.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation, installed, or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

In one embodiment, a gravity fed non-electric pellet stove 100 separates combustible gases from non-combustible materials in biomass pellets (e.g., wood pellets). Biomass pellets are heated (e.g., burned) in a primary burn chamber 102 to separate the pellets into combustible gases and coals. The coals produced are heated (e.g., burned) in a coal burn chamber 104 chamber separately from the pellets to separate the coals into additional combustible gases and ash. In one embodiment, a grate 110 separates the primary combustion chamber 102 from the coal burn chamber 104. The combustible gases from the pellets and from the coals are joined in a combustible gases chamber 106 together with secondary combustion air to convert the combustible gases and secondary combustion air into exhaust gases. It has been found that pellets, coals, and combustible gases require different amounts of combustion air for high efficiency heat release and low emissions (i.e., the combustible gases require significantly more combustion air than the coals). By separating the pellets, coals, and combustible gases into different combustion chambers, differing amounts of combustion air may be provided to each. Thus, the velocity of air passing over hot coals is significantly reduced which in turn reduces the instances of clinkers. A clinker is a result of non-biomass impurities found in pellets fusing together with ash at high temperatures. Temperatures high enough to cause this fusion result from air velocity in excess of that needed to release the combustible gases from the coals (i.e., burn the coals). Clinkers increase the waste product a stove produces requiring additional cleaning and maintenance as well as reducing the overall heating efficiency of the appliance due to incomplete fuel burn. Additionally, by providing optimal combustion air flow to the fuel type in each combustion chamber, efficient burning with reduced emissions is achieved.

The geometry of the burn chambers, air inlets, exhaust path, firepot (i.e., bottom of the primary combustion chamber 102 formed by the grate 110 and sidewalls of the primary combustion chamber 102) configuration control the entire burn process in the system 100. In one embodiment, a gravity fed gasifying pellet stove 100 provides improved efficiency, offers a radiating warmth, reduces the cleaning requirements, and provides an aesthetically pleasing flame and coal appearance. This is accomplished by separating the burn chambers for the pellets, coals, and combustible gases and providing windows into the coal burn chamber 104 and gas burn chamber 102 (i.e., gas combustion chamber). The system 100 is designed such that the volume of air required for the respective combustion of the combustible gases, raw pellets, and coals is regulated to provide the proper stoichiometric ratio for each combustible material in its respective burn chamber. In operation, biomass pellets feed in from a storage hopper 120 above the primary burn chamber 102 and begin to burn on the grate 110. In the primary burn chamber 102, the combustible gases are released from the pellets via heating and mixing with primary combustion air (i.e., burning). As that process occurs, the pellets shrink and drop through the burn grate 110 into the coal burn chamber 104. Once the coals drop into the coal burn chamber 104, the coals continue to burn without major visible flames (i.e., smolder), and the coals proceed to emit the remainder of their combustible gases. The rate of burn, and thus heat output of the stove 100, is controlled through an adjustable air inlet device (i.e., air control valve 130) that allows air into the system 100. The air fed into the system 100 via the air inlet device 130 proceed to either feed into the coal burn chamber 104 as primary combustion air or feed into the gas burn chamber 106 as secondary combustion air. The primary combustion air entering the coal burn chamber 104 sweeps over the top of the burning coals and then splits where it is distributed in specific ratios between both the primary burn chamber 102 of the pellets and combustible gas burn chamber 106 above the primary burn chamber 102 and coal burn chamber 104. This ratio is determined as a function of the permeability of the bottom of the gas burn chamber 102 (i.e., grate 110) and a sidewall 112 of the primary burn chamber 102. In one embodiment, the sidewall 112 of the primary burn chamber 102 is a front wall of the primary burn chamber 102 (which separates the primary burn chamber 102 from the coal burn chamber 104), and the sidewall 112 is made air permeable by one or more holes therethrough. Thus, primary combustion air and combustible gases from the coal burning chamber 104 join combustible gases (and potentially some primary combustion air) from the primary combustion chamber as they pass from the primary combustion chamber 102 to the gas burn chamber 106, where they all mix with secondary combustion air and burn as a pleasing, unforced, flame in the combustible gas chamber 106. Thus, the system 100 is designed so the burn grate 110 that separates the primary burn chamber 102 and coal burn chamber 104 and neither require daily cleaning due to bridging of ash or clinkers. This is accomplished through the geometry of the system 100 which in turn controls the volume of fuel, air, and velocity of air respective to the burn chambers.

In one embodiment, a gravity fed pellet stove 100 has three combustion chambers or zones. The first zone 102 is the point of primary combustion including a burn grate 110 that is at the end of a fuel drop tube. The primary combustion zone 102 is located below the fuel storage hopper 120. The second combustion zone 104 is below the burn basket or grate 110 where combustion of the coals take place. The third zone 106 is above the burn grate 110 where mixing of combustion gases from the other two zones and various air streams burn up the remaining fuels (i.e., combustible gases) exiting from the first and second zones.

In one embodiment, a biomass pellet combustion system 100 includes a primary burn chamber 102, a coal burn chamber 104, and a gas burn chamber 106. The primary burn chamber 102 is configured to receive pellets from a drop tube 122 of the biomass pellet combustion system 100. The primary burn chamber 102 is configured to separate the received pellets into combustible gases and coals. In one embodiment, the primary burn chamber 102 separates the pellets and combustible gases and coals by heating the pellets. In one embodiment, the primary burn chamber 102 is further configured separate the pellets into coals and combustible gases by mixing the pellets with primary combustion air. The primary combustion air is received through a grate 110 (e.g., a porous burn pot or fire pot) forming the bottom of the primary combustion chamber 102. In this fashion, primary combustion reduces the size of pellets in the primary burn chamber 102 by mixing primary combustion air with the pellets and heating the pellets until the pellets become coals and drop through the grate 110 into the coal burn chamber 104.

The coal burn chamber 104 is configured to receive coals from the primary burn chamber 102. The coal burn chamber 104 is configured to separate the coals received from the primary burn chamber 102 into combustible gases and ash. In one embodiment, the coal burn chamber 104 separates the coals into combustible gases and ash by heating the coals. In one embodiment, the coal burn chamber is further configured to separate the coals into ash and combustible gases by mixing the pellets with primary combustion air. In this way, primary combustion mixes primary combustion air with the coals in the coal burn chamber 104 converting the coals into ash and combustible gases within the coal burn chamber 104. In one embodiment, all primary combustion air entering the system enters through the coal burn chamber. That is, the primary combustion air provided to the coals in the coal burn chamber enters the combustion chambers at the coal burn chamber 104, and the primary combustion air entering the primary burn chamber 102 enters the primary burn chamber 102 from the coal burn chamber 104.

The gas burn chamber 106 is configured to receive combustible gases from both the primary burn chamber 102 and the coal burn chamber 104. A secondary combustion process converts secondary combustion air and the combustible gases into exhaust gases in the gas burn chamber. As discussed above, some primary combustion air entering the coal burn chamber 104 will proceed to the gas burn chamber 106 and become secondary combustion air for burning the combustible gases released from the coals and pellets. In one embodiment, all additional secondary combustion air enters the combustion chambers of the system 100 at the gas burn chamber 106. In one embodiment, the additional secondary combustion air enters the gas burn chamber 106 at a top of the gas burn chamber 106 such that the secondary combustion air washes down the backside of a front window 140 of the gas burn chamber 106.

Figure 5:
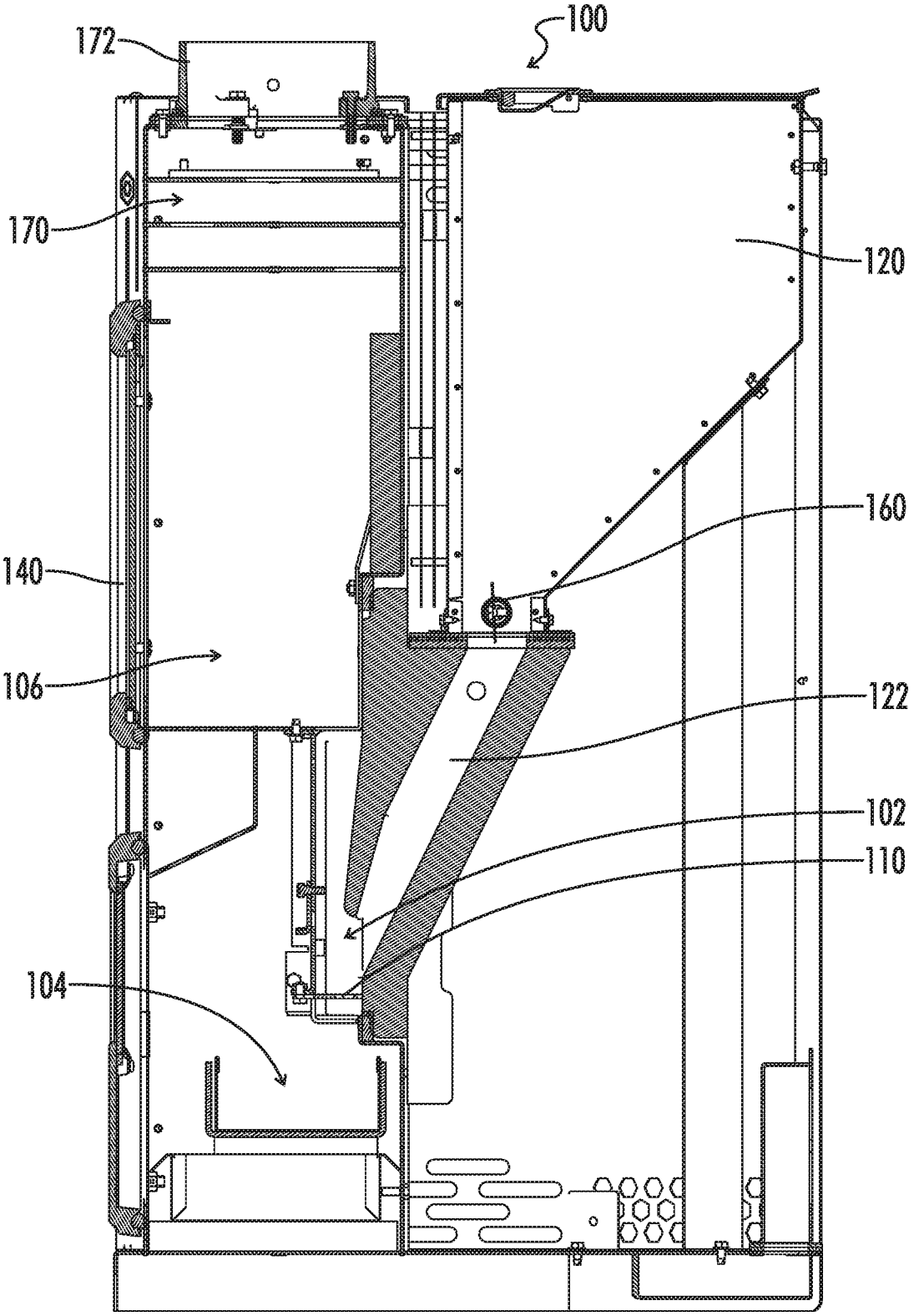
FIG. 5 is a cutaway perspective view of a biomass pellet combustion system.
Figure 6:
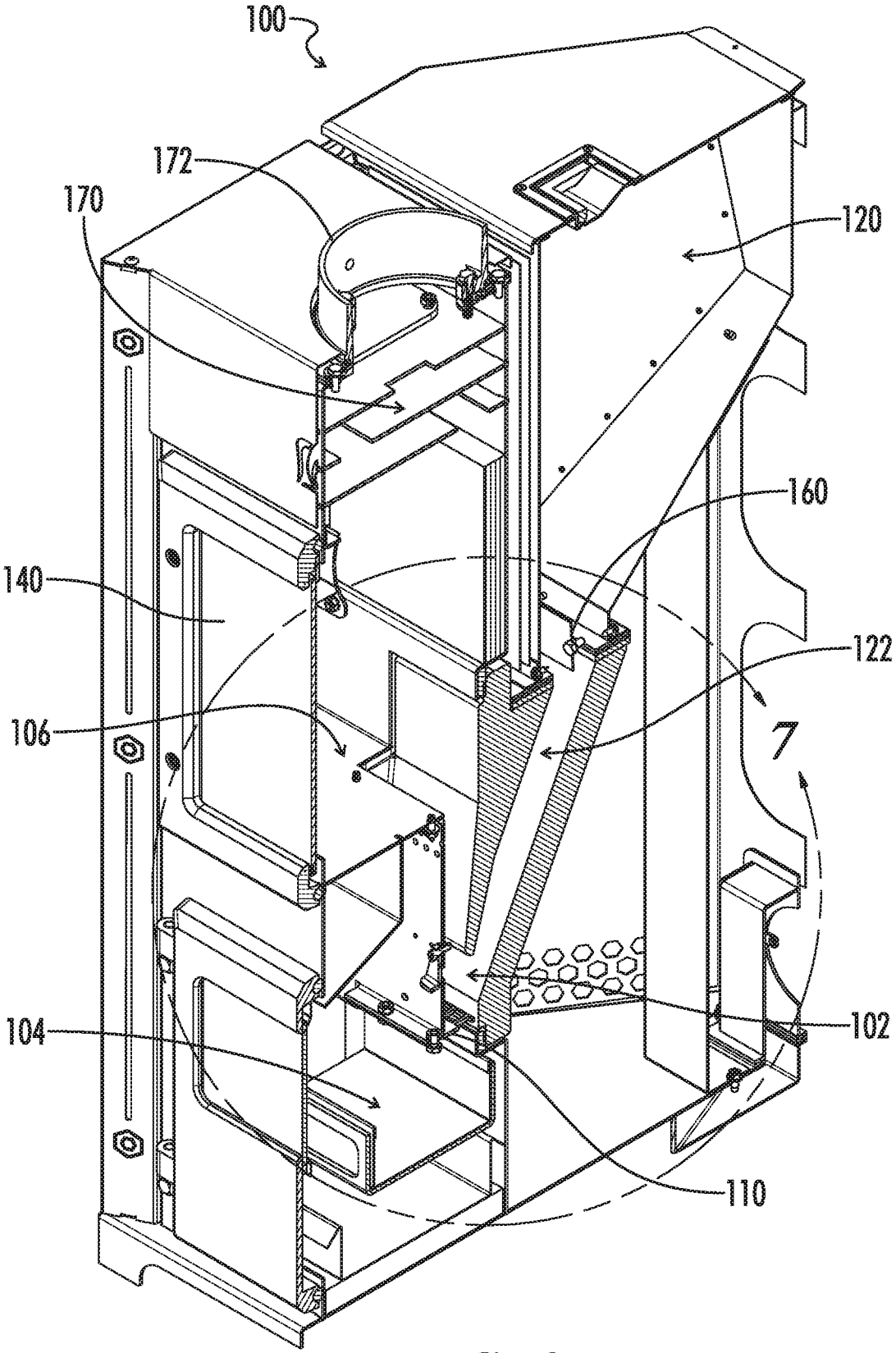
FIG. 6 is a cutaway isometric view of a biomass pellet combustion system showing a selected area of the biomass pellet combustion system.
Figure 7:
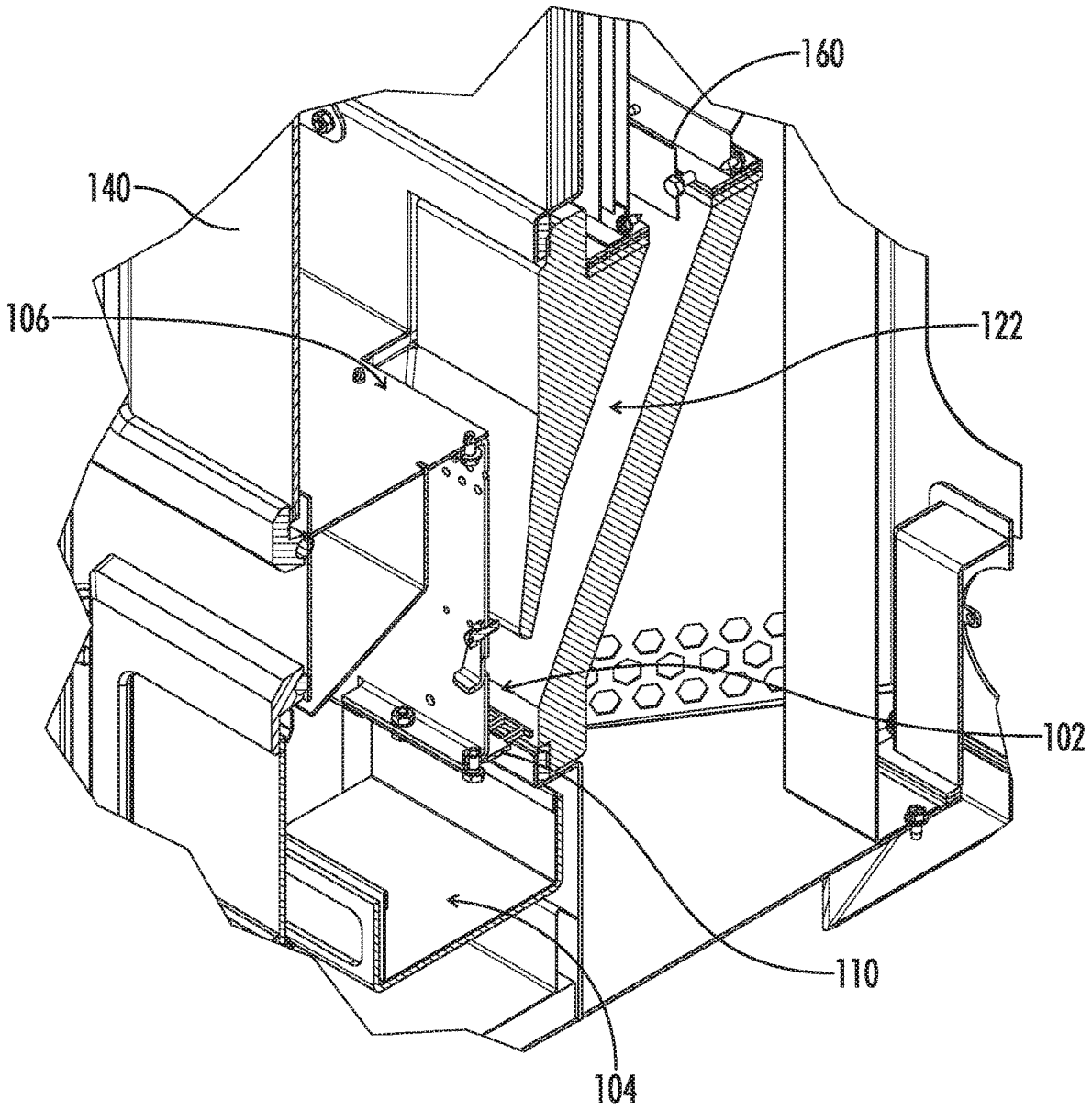
FIG. 7 is a cutaway isometric view of the selected area of the biomass pellet combustion system of FIG. 6.
Figure 8:
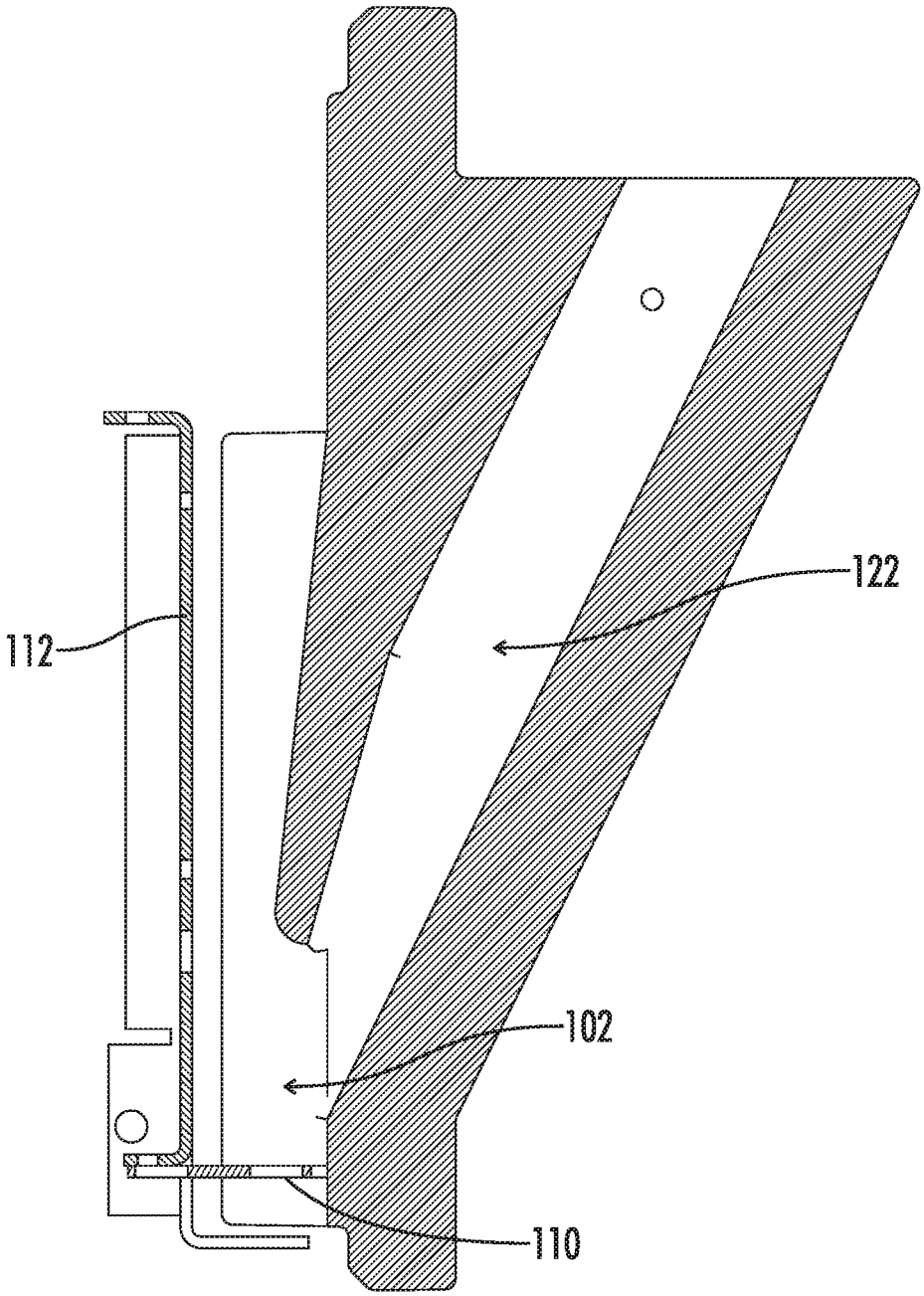
FIG. 8 is a side perspective cutaway view of a drop tube and primary burn chamber of a biomass pellet combustion system.
Figure 9:
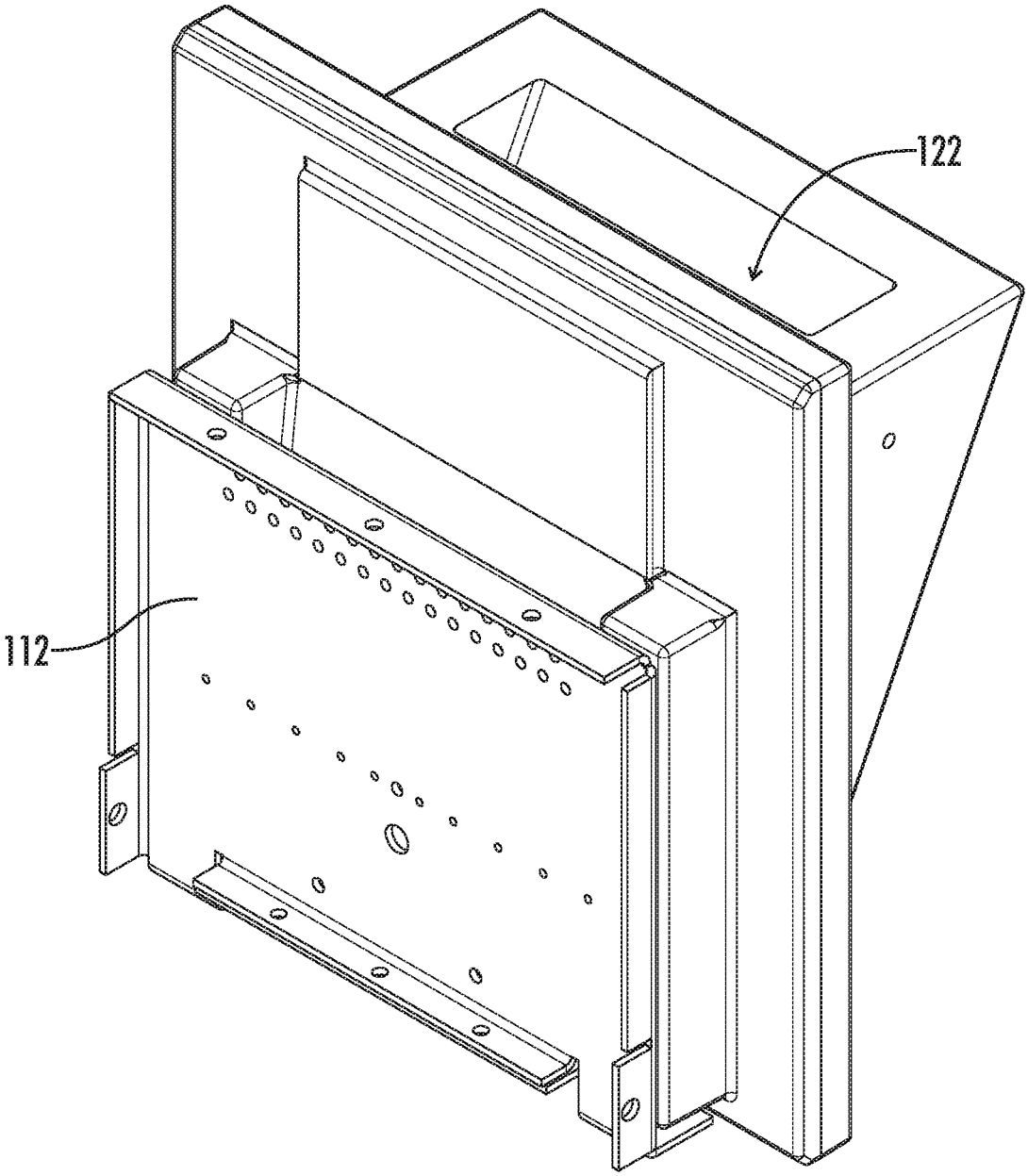
FIG. 9 is an isometric view of the drop tube and primary burn chamber of the biomass pellet combustion system of FIG. 8.
Figure 10:
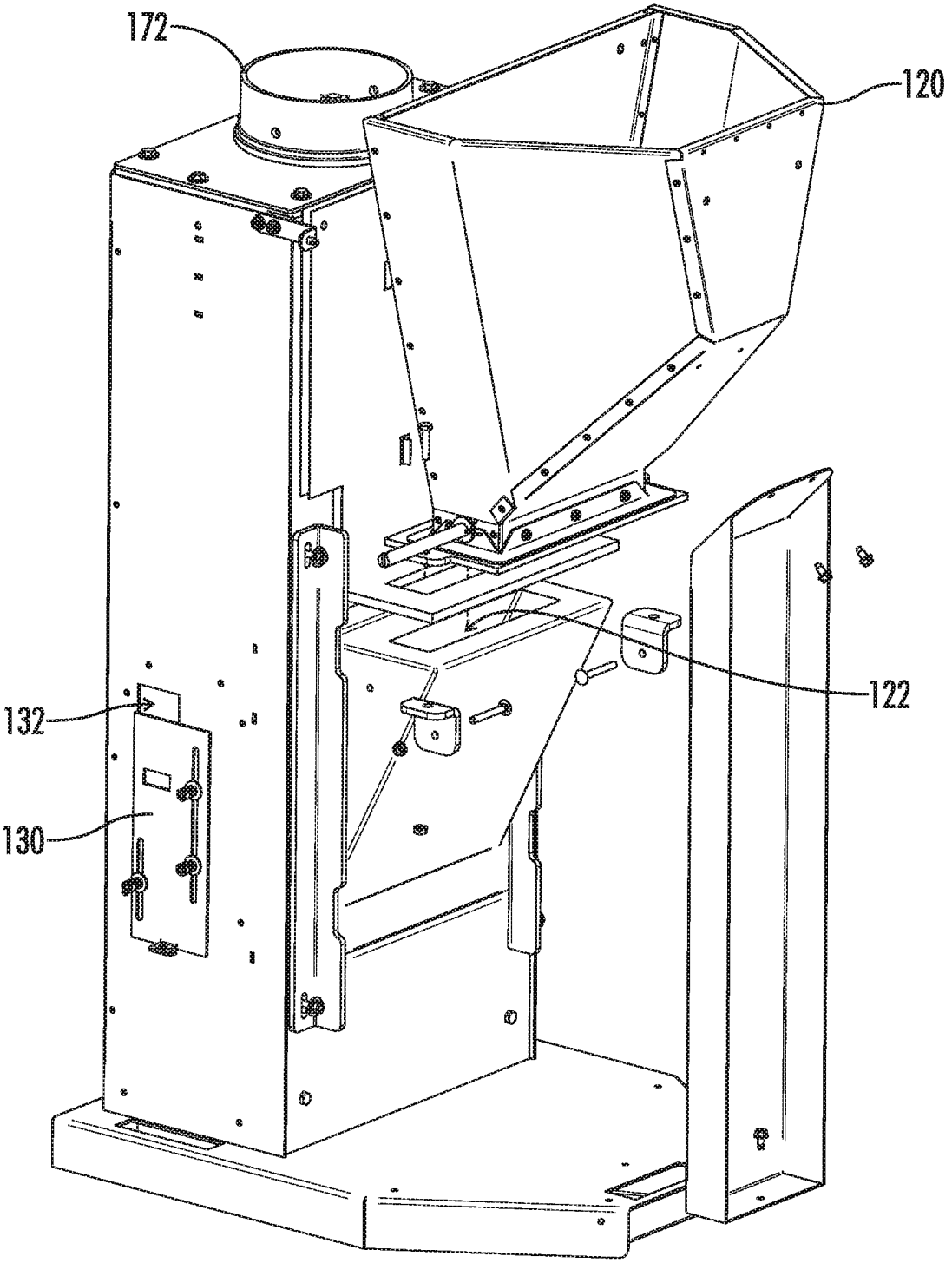
FIG. 10 is a partially exploded rear isometric view of a biomass pellet combustion system.

Referring more specifically to FIGS. 5-9, in one embodiment, the system 100 further includes an isolation plate 160. The isolation plate 160 is at least partially in the drop tube 122. The isolation plate 160 is configured to reduce exposure of the biomass pellets in the drop tube 122 to heating prior to the biomass pellets entering the primary combustion chamber 102. In one embodiment, the Hopper 120 is connected to the primary combustion chamber by the drop tube 122. The isolation plate 160 in the drop tube 122 is configured to isolate pellets in the Hopper 120 from excess heat and exposure to combustible gases as pellets remaining in the drop tube 122 and primary combustion chamber 122 are converted in the combustible gases and coals. In one embodiment, the isolation plate 160 in the drop tube 122 extends laterally across the drop tube 122 and vertically into the drop tube 122 and into the Hopper 120 above the drop tube 122. In one embodiment, the drop tube 122 extends upward and rearward from the primary combustion chamber 102. The Hopper 120 is above the drop tube 122 and rearward of the gas burn chamber 106.

In one embodiment, the gas burn chamber 106 is above the primary combustion chamber 102 and the coal burn chamber 104. Combustion gases from the pellets in the primary combustion chamber 102 rise into the gas burn chamber 106. The primary combustion chamber 102 is configured to mix combustion gases from the coal burn chamber 104 with combustion gases from the primary combustion chamber 102 prior to the combustion gases entering the gas burn chamber 106. In one embodiment, these combustion gases into the gas burn chamber 106 at a bottom rear portion of the gas burn chamber 106.

Figure 2:
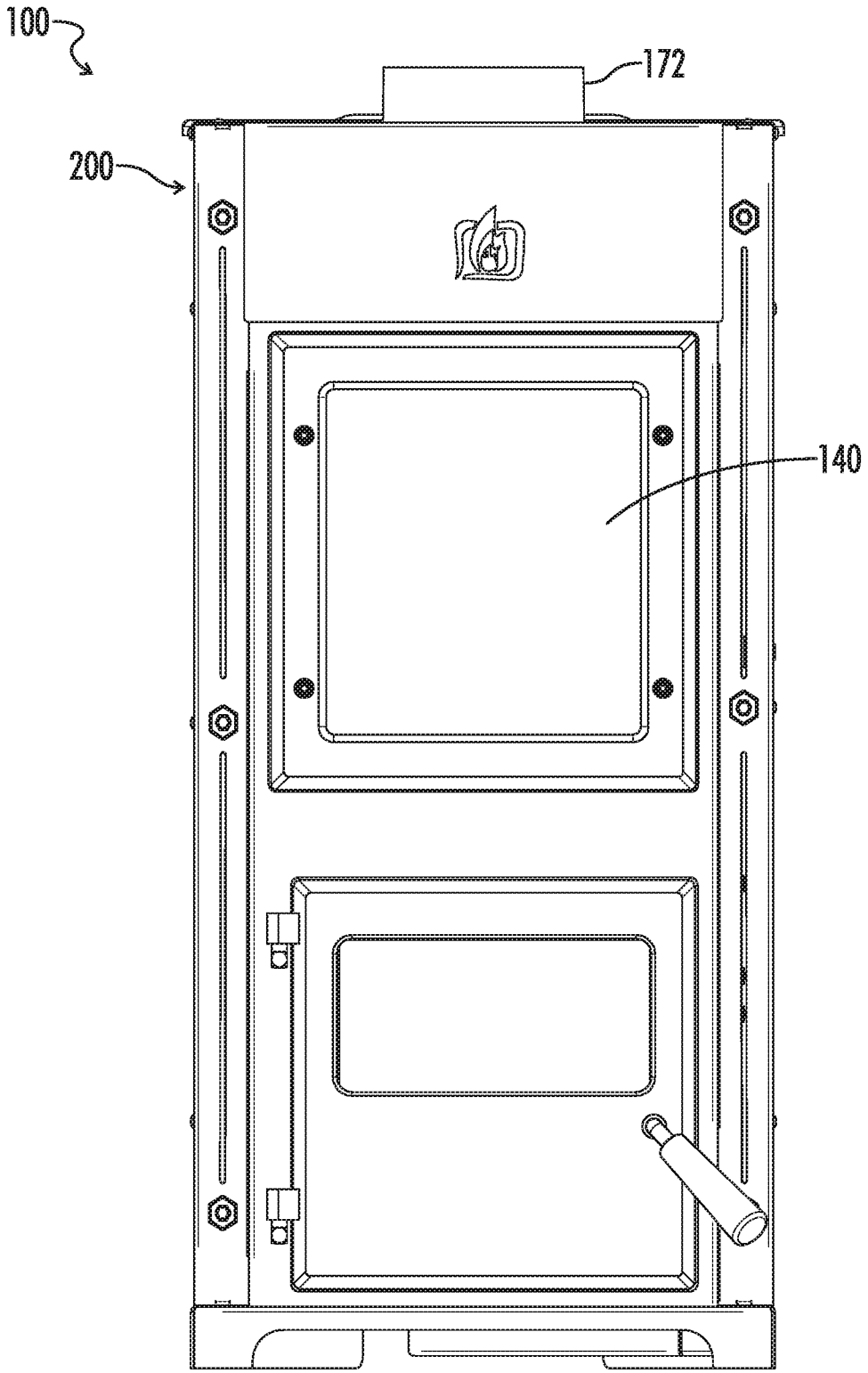
FIG. 2 is a front perspective view of a biomass pellet combustion system shown in an installed and upright position.
Figure 3:
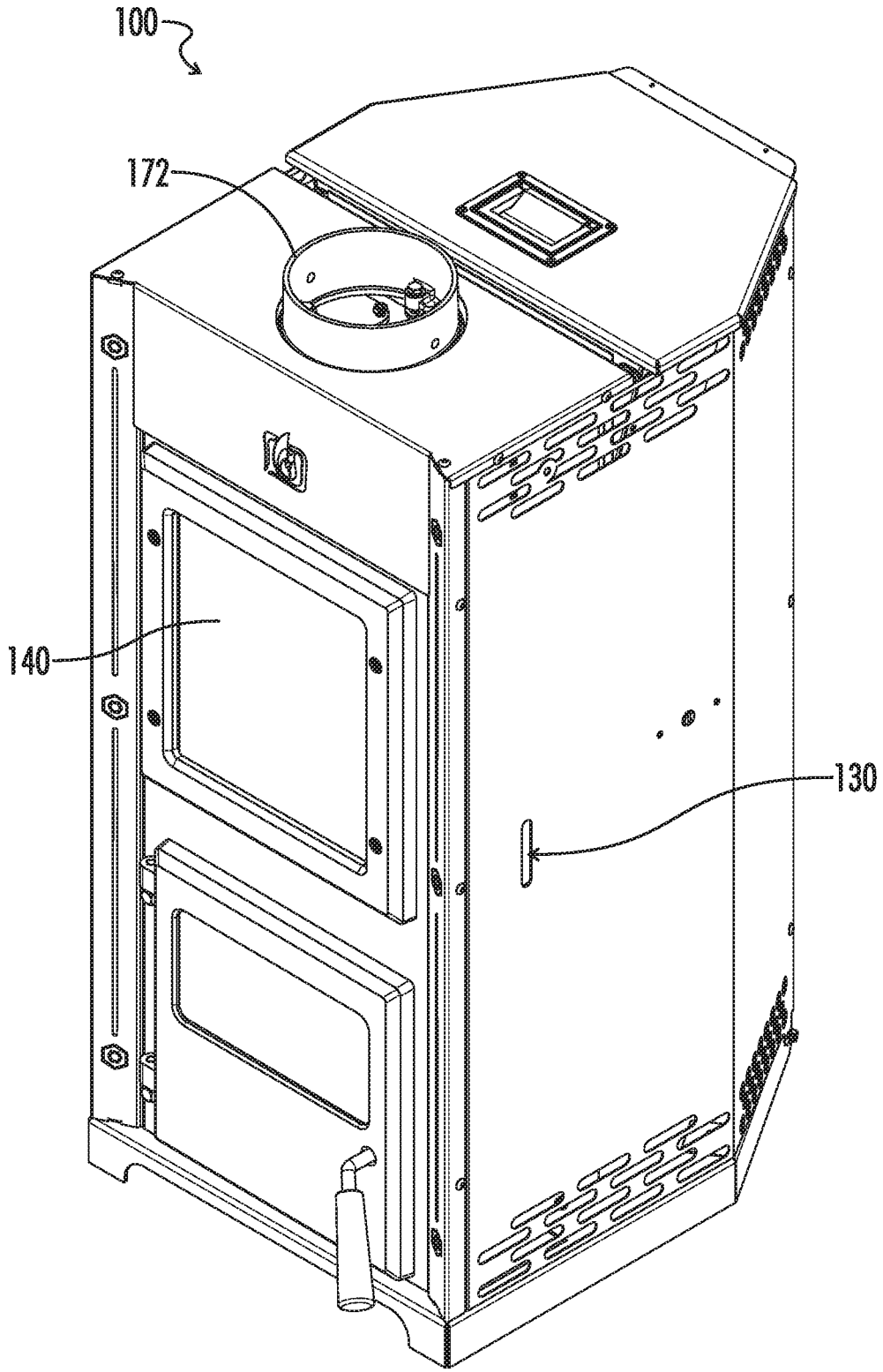
FIG. 3 is an isometric view of a biomass pellet combustion system.
Figure 4:
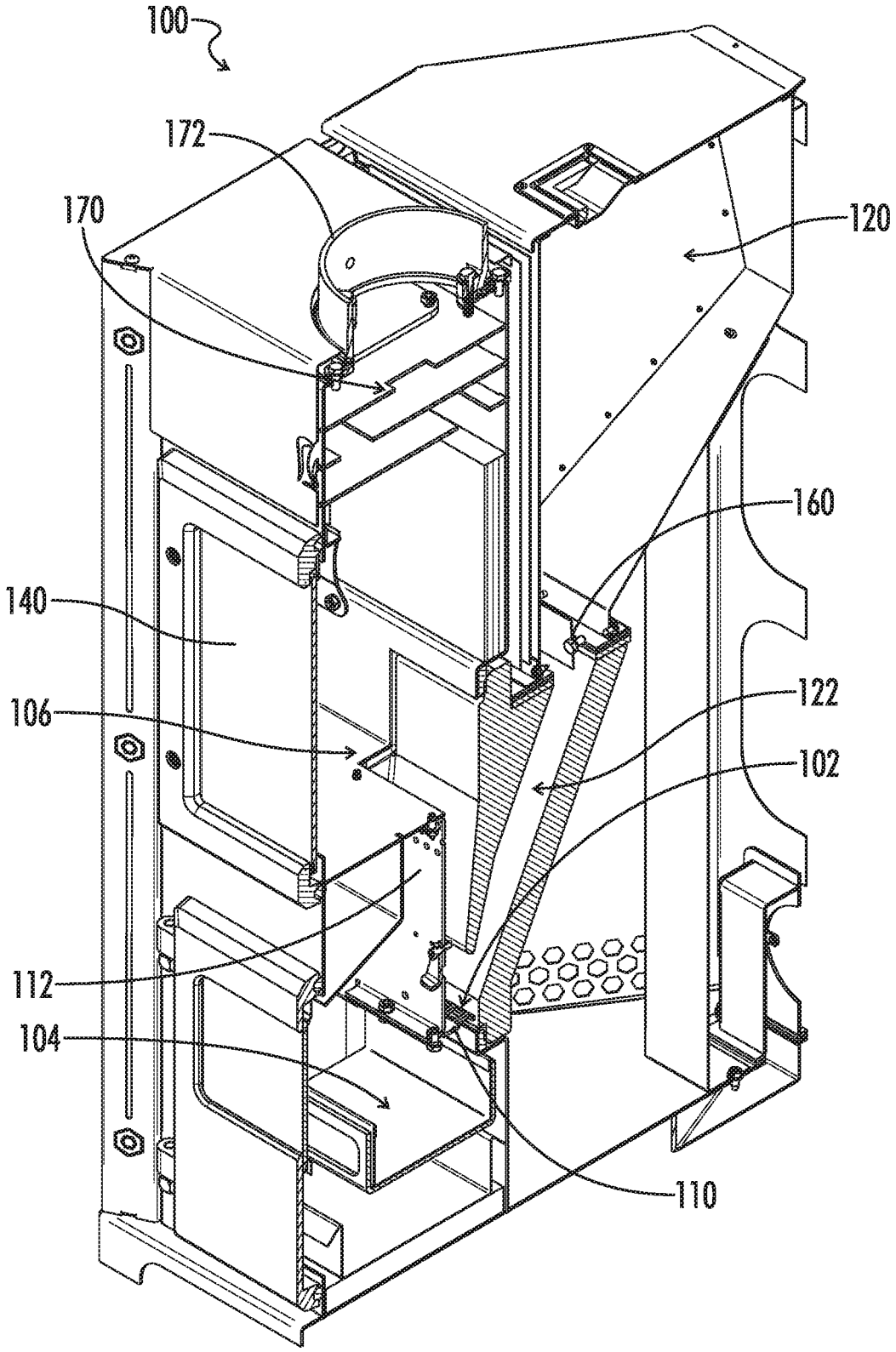
FIG. 4 is an isometric cutaway view of a biomass pellet combustion system.

Referring more specifically to FIGS. 1 through 6, primary combustion air and secondary combustion air enter the system 100 through common inlet 132. The system 100 further includes a control valve 130 configured to determine total amount of primary and secondary combustion air entering the system 100 through the common inlet 132. In one embodiment, the system 100 further includes an exhaust gas to heat exchanger 170 and flue 172 above the gas burn chamber 106. The control valve 130 of the system 100 is in front of the exhaust gas heat exchanger 170 such that combustion air entering the system 100 is preheated by the exhaust gas heat exchanger 170 before entering the gas burn chamber 106 is secondary combustion air or the coal burn chamber 104 as primary combustion air.

In one embodiment, the system 100 further includes a housing 200 supporting at least the primary combustion chamber 102, burn chamber 104, gas burn chamber 106, drop tube 122, exhaust gas heat exchanger 172, front window 140, and flue 170.

This written description uses examples to disclose the invention and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful BIOMASS PELLET COMBUSION SYSTEM, it is not intended that such references be construed as limitations upon the scope of this invention except as set forth in the following claims.

What is claimed is:

1. A biomass pellet combustion system comprising:
- a primary burn chamber configured to receive pellets from a drop tube of the biomass pellet combustion system;
- a coal burn chamber configured to receive coals from the primary burn chamber; and
- a gas burn chamber configured to receive combustible gases from both the primary burn chamber and the coal burn chamber, wherein a secondary combustion process converts secondary combustion air and the combustible gases into exhaust gases in the gas burn chamber, wherein:
  - a bottom of the primary burn chamber is formed by a grate;
  - primary combustion reduces the size of pellets in the primary burn chamber by mixing primary combustion air with the pellets until the pellets become coals and drop through the grate into the coal burn chamber;
  - primary combustion mixes primary combustion air with the coals in the coal burn chamber converting the coals into ash and combustible gases within the coal burn chamber;
  - primary combustion air and secondary combustion air enter the system through a common inlet; and
  - the system further comprises a control valve configured to determine a total amount of primary and secondary combustion air entering the system through the common inlet.

2. The biomass pellet combustion system of claim 1, wherein:
- the primary burn chamber is further configured to separate the received pellets into combustible gases and coals; and
- the coal burn chamber is further configured to separate the coals received from the primary burn chamber into combustible gases and ash.

3. The biomass pellet combustion system of claim 2, wherein:
- the primary burn chamber separates the pellets into combustible gases and coals by heating the pellets.

4. The biomass pellet combustion system of claim 2, wherein:
- the coal burn chamber separates the coals into combustible gases and ash by combustion.

5. The biomass pellet combustion system of claim 2, wherein:
- the primary burn chamber is configured to separate the pellets into coals and combustible gases by mixing the pellets with primary combustion air; and
- the coal burn chamber is configured to separate the coals into ash and combustible gases by mixing the pellets with primary combustion air.

6. The biomass pellet combustion system of claim 1, wherein:
- the grate is configured to support the pellets while primary combustion converts primary combustion air and the pellets into coals and combustible gases.

7. The biomass pellet combustion system of claim 1, wherein:

all primary combustion air entering the system enters the coal burn chamber; and all primary combustion air entering the primary burn chamber enters the primary burn chamber from the coal burn chamber.

8. The biomass pellet combustion system of claim 1, wherein:

all primary combustion air entering the system enters the coal burn chamber;

all primary combustion air entering the primary burn chamber enters the primary burn chamber from the coal burn chamber; and secondary combustion air enters the system at the gas burn chamber.

9. The biomass pellet combustion system of claim 1, wherein:

all primary combustion air entering the system enters the coal burn chamber;

all primary combustion air entering the primary burn chamber enters the primary burn chamber from the coal burn chamber;

secondary combustion air enters the system at the gas burn chamber through a wall of the gas burn chamber other than a bottom of the gas burn chamber; and a portion of the primary combustion air mixes with combustible gases from the coal burn chamber and the primary burn chamber as the combustible gases rise from the primary burn chamber and coal burn chamber to the gas burn chamber through the bottom of the gas burn chamber such that said portion of the primary combustion air becomes secondary combustion air.

10. The biomass pellet combustion system of claim 1, wherein:

secondary combustion air enters the gas burn chamber at a top of the gas burn chamber such that the secondary combustion air washes down a back side of a front window of the gas burn chamber.

11. The biomass pellet combustion system of claim 1, further comprising:

an isolation plate in the drop tube, wherein the isolation plate is configured to reduce exposure of the biomass pellets in the drop tube to heating prior to the biomass pellets entering the primary combustion chamber.

12. The biomass pellet combustion system of claim 1, further comprising:

a hopper connected to the primary combustion chamber by the drop tube; and an isolation plate in the drop tube, wherein the isolation plate is configured to isolate pellets in the hopper from excess heat and exposure to combustible gases as pellets in the primary combustion chamber and drop tube are converted int o coals and combustible gases.

13. The biomass pellet combustion system of claim 1, further comprising:

an isolation plate in the drop tube extending laterally across the drop tube and vertically into the drop tube and into a hopper above the drop tube.

14. The biomass pellet combustion system of claim 1, wherein:

the gas burn chamber is above the primary combustion chamber and the coal burn chamber;

combustion gases from the pellets in the primary combustion chamber rise into the gas burn chamber; and the primary combustion chamber is configured to mix combustion gases from coal burn chamber with combustion gases from the primary combustion chamber prior to the combustion gases entering the gas burn chamber.

15. The biomass pellet combustion system of claim 1, wherein:

the gas burn chamber is above the primary combustion chamber;

the primary combustion chamber is above the coal burn chamber;

the drop tube extends upward and rearward from the primary combustion chamber;

an exhaust gas heat exchanger of the system is above the gas burn chamber;

a flue of the system is above the exhaust gas heat exchanger;

a hopper of the system is above the drop tube and rearward of the gas burn chamber;

a front of the gas burn chamber is at least partially formed by a front window;

the control valve of the system is in front of the exhaust gas heat exchanger such that combustion air entering the system is preheated by the exhaust gas heat exchanger before entering the gas burn chamber as secondary combustion air or the coal burn chamber as primary combustion air.

16. The biomass pellet combustion system of claim 1, wherein:

the system is a wood pellet stove configured to radiate heat into a space adjacent the stove.

* * * * *